US011499395B2

(12) United States Patent
Parameshwaraiah et al.

(10) Patent No.: US 11,499,395 B2
(45) Date of Patent: Nov. 15, 2022

(54) FLAPPER DISK FOR BUOYANCY ASSISTED CASING EQUIPMENT

(71) Applicant: Halliburton Energy Services, Inc., Houston, TX (US)

(72) Inventors: Rajesh Parameshwaraiah, Houston, TX (US); Lonnie Carl Helms, Humble, TX (US); Min Mark Yuan, Katy, TX (US); Handoko Tirto Santoso, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 21 days.

(21) Appl. No.: 16/550,994

(22) Filed: Aug. 26, 2019

(65) Prior Publication Data

US 2021/0062616 A1 Mar. 4, 2021

(51) Int. Cl.

| | |
|---|---|
| ***E21B 34/14*** | (2006.01) |
| ***E21B 34/06*** | (2006.01) |
| ***E21B 34/08*** | (2006.01) |
| ***F16K 15/00*** | (2006.01) |
| ***E21B 34/10*** | (2006.01) |
| ***E21B 29/00*** | (2006.01) |

(52) U.S. Cl.
CPC ..... *E21B 34/14* (2013.01); *E21B 2200/05* (2020.05)

(58) Field of Classification Search
None
See application file for complete search history.

(56) References Cited

U.S. PATENT DOCUMENTS

| | | | | |
|---|---|---|---|---|
| 3,463,351 | A | 8/1969 | Mills | |
| 3,779,263 | A | 12/1973 | Edwards et al. | |
| 3,980,134 | A | 9/1976 | Amancharla | |
| 4,457,376 | A * | 7/1984 | Carmody | E21B 34/10 251/298 |
| 4,890,674 | A * | 1/1990 | Le | E21B 34/105 251/63.4 |
| 5,150,756 | A | 9/1992 | Hassanzadeh | |

(Continued)

FOREIGN PATENT DOCUMENTS

| | | |
|---|---|---|
| EP | 0566290 A1 | 10/1993 |
| EP | 0681087 B1 | 9/2000 |

(Continued)

OTHER PUBLICATIONS

International Search Report and Written Opinion dated Aug. 14, 2018, issued in PCT Application No. PCT/US2017/062528.

(Continued)

*Primary Examiner* — Matthew Troutman
*Assistant Examiner* — Douglas S Wood
(74) *Attorney, Agent, or Firm* — McAfee & Taft

(57) ABSTRACT

A buoyancy assist tool and a fluid barrier in a casing string define a buoyancy chamber therebetween. The buoyancy assist tool has a housing connected in the casing string with a retaining sleeve detachably connected in the housing. The retaining sleeve is movable from a first to a second position in the housing. A flapper disk is positioned in the housing and covers an upper end of the retaining sleeve in the first position of the retaining sleeve. In the second position of the retaining sleeve the flapper disk is in a retracted position out of the flow path through the housing.

19 Claims, 8 Drawing Sheets

(56) References Cited

U.S. PATENT DOCUMENTS 5,479,986 A 1/1996 Gano et al.
5,765,641 A * 6/1998 Shy ..... E21B 23/00 166/292
5,826,661 A * 10/1998 Parker ..... E21B 23/00 166/386
6,026,903 A * 2/2000 Shy ..... E21B 23/00 166/192
6,076,600 A 6/2000 Vick, Jr. et al.
6,161,622 A 12/2000 Robb et al.
6,324,904 B1 12/2001 Ishikawa et al.
6,450,263 B1 9/2002 Schwendemann
6,505,685 B1 * 1/2003 Sullaway ..... E21B 21/10 166/191
6,622,798 B1 9/2003 Rogers et al.
6,651,748 B2 11/2003 Sullaway et al.
6,672,389 B1 1/2004 Hinrichs
6,758,281 B2 7/2004 Sullaway et al.
7,270,191 B2 * 9/2007 Drummond ..... G09F 3/20 166/332.8
7,299,880 B2 * 11/2007 Logiudice ..... E21B 21/103 166/334.4
8,261,836 B2 * 9/2012 Noske ..... E21B 21/08 137/527
8,505,621 B2 8/2013 Telfer et al.
8,579,027 B2 * 11/2013 Abdelmalek ..... E21B 34/10 166/250.17
9,033,055 B2 * 5/2015 Mccoy ..... E21B 34/14 166/373
9,309,752 B2 4/2016 Talley et al.
9,441,437 B2 9/2016 Fripp et al.
9,441,446 B2 * 9/2016 Fripp ..... E21B 29/02
9,518,445 B2 * 12/2016 Noske ..... E21B 21/103
9,540,904 B2 1/2017 Petrowsky
9,593,542 B2 3/2017 Getzlaf et al.
10,138,707 B2 11/2018 Tolman et al.
10,323,478 B2 * 6/2019 Berscheidt ..... E21B 33/1294
10,808,490 B2 * 10/2020 Giroux ..... E21B 43/10
10,883,315 B2 * 1/2021 Getzlaf ..... E21B 7/20
10,995,583 B1 * 5/2021 Helms ..... E21B 34/063
11,208,870 B2 * 12/2021 Galindo ..... E21B 34/14
11,293,261 B2 * 4/2022 Yuan ..... E21B 34/063
2002/0185273 A1 12/2002 Aronstam et al.
2003/0116324 A1 6/2003 Dawson et al.
2003/0217844 A1 11/2003 Moyes
2008/0029273 A1 * 2/2008 Pia ..... E21B 34/102 166/373
2008/0073075 A1 3/2008 Buyers et al.
2008/0115942 A1 5/2008 Keller et al.
2010/0270031 A1 10/2010 Patel
2010/0294376 A1 11/2010 O'Brien et al.
2011/0042099 A1 2/2011 Williamson, Jr. et al.
2011/0253392 A1 10/2011 May et al.
2012/0111566 A1 5/2012 Sherman et al.
2014/0174757 A1 6/2014 Fripp et al.
2014/0216756 A1 8/2014 Getzlaf et al.
2014/0224505 A1 8/2014 Ramon
2014/0338923 A1 11/2014 Fripp et al.
2015/0107843 A1 4/2015 Talley et al.
2015/0129205 A1 5/2015 Hofman et al.
2015/0240596 A1 8/2015 Horwell
2016/0177668 A1 * 6/2016 Watson ..... E21B 21/10 166/373
2016/0333658 A1 11/2016 Keshishian et al.
2017/0096875 A1 4/2017 Ravensbergen et al.
2017/0138153 A1 5/2017 Getzlaf et al.
2018/0003004 A1 1/2018 Norman et al.
2018/0058179 A1 3/2018 Nuryaningsih et al.
2018/0080308 A1 3/2018 Dedman et al.
2018/0219200 A1 8/2018 Albukrek et al.
2018/0262127 A1 9/2018 Gooneratne et al.
2018/0371869 A1 12/2018 Kellner et al.
2019/0128081 A1 * 5/2019 Ross ..... E21B 33/124
2019/0352994 A1 11/2019 Giroux
2019/0352995 A1 11/2019 Giroux et al.

FOREIGN PATENT DOCUMENTS

EP 1009907 B1 2/2006
GB 2388139 A * 11/2003 ..... E21B 21/00
GB 2483869 A 3/2012
JP 6551001 B2 7/2019
WO 2014098903 A1 6/2014
WO 2015073001 A1 5/2015
WO 2016176643 A1 11/2016
WO 2019099046 A1 5/2019

OTHER PUBLICATIONS

International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 23, 2019, issued in PCT Application No. PCT/US2018/064085.
International Search Report and Written Opinion dated Aug. 14, 2019, issued in PCT Application No. PCT/US2018/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/031541.
International Search Report and Written Opinion dated Jan. 16, 2020, issued in PCT Application No. PCT/US2019/027625.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application PCT/US2019/059757.
International Search Report and Written Opinion dated Jul. 21, 2020, issued in PCT Application No. PCT/US2019/059864.
International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.

* cited by examiner

FLAPPER DISK FOR BUOYANCY ASSISTED CASING EQUIPMENT

BACKGROUND

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

DESCRIPTION OF THE DRAWINGS

FIG. 6 is a perspective view looking at the underside of the flapper disk of the current disclosure.

FIG. 9 is a view from line 9-9 of FIG. 7.

DESCRIPTION

Figure 1:
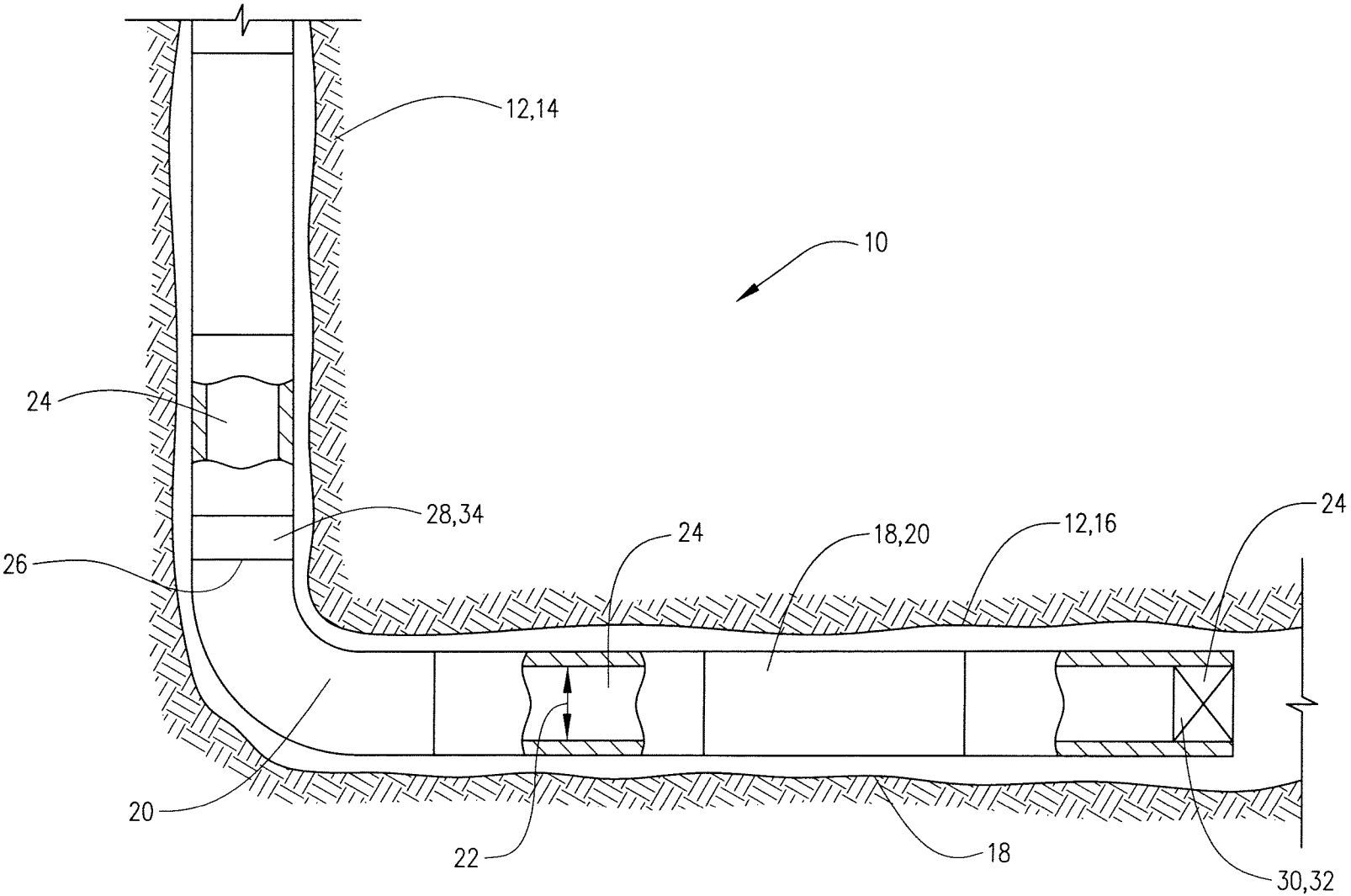
FIG. 1 is a schematic view of an exemplary well bore with a well casing including a buoyancy chamber therein.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these is used is a factor of the well conditions and the amount of buoyancy desired.

Lower boundary 30 may comprise a float device 32 such as a float shoe or float collar. As is known, such float devices will generally allow fluid flow downwardly therethrough but will prevent flow upwardly into the casing. The float devices are generally a one-way check valve. The float device 30 is thus a fluid barrier that will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 has an outer case or outer housing 36. Buoyancy assist tool 34 has upper end 38 and lower end 40 and defines flow path 35 therethrough. In the embodiment described outer case 36 comprises a top sub 42 with upper end 38 and a bottom end 44. The bottom sub 46 is connected to top sub 42 and has upper end 46 and lower end 40 which is the lower end of outer case 36. Buoyancy assist tool 34 is connected to a plurality of casing joints thereabove, and a plurality of casing joints connects the buoyancy assist tool 34 to the flow barrier 32.

Top sub 42 has inner surface 50 defining an inner diameter 52 which is a minimum inner diameter and an inner diameter 53 which is the maximum or second inner diameter of top sub 42. Bottom sub 46 has inner surface 54 that defines a minimum inner diameter or first inner diameter 56 and a second or maximum inner diameter 58. Diameters 56 and 58 define an upward facing shoulder 60 in housing 36 and more specifically in bottom sub 46.

Figure 2:
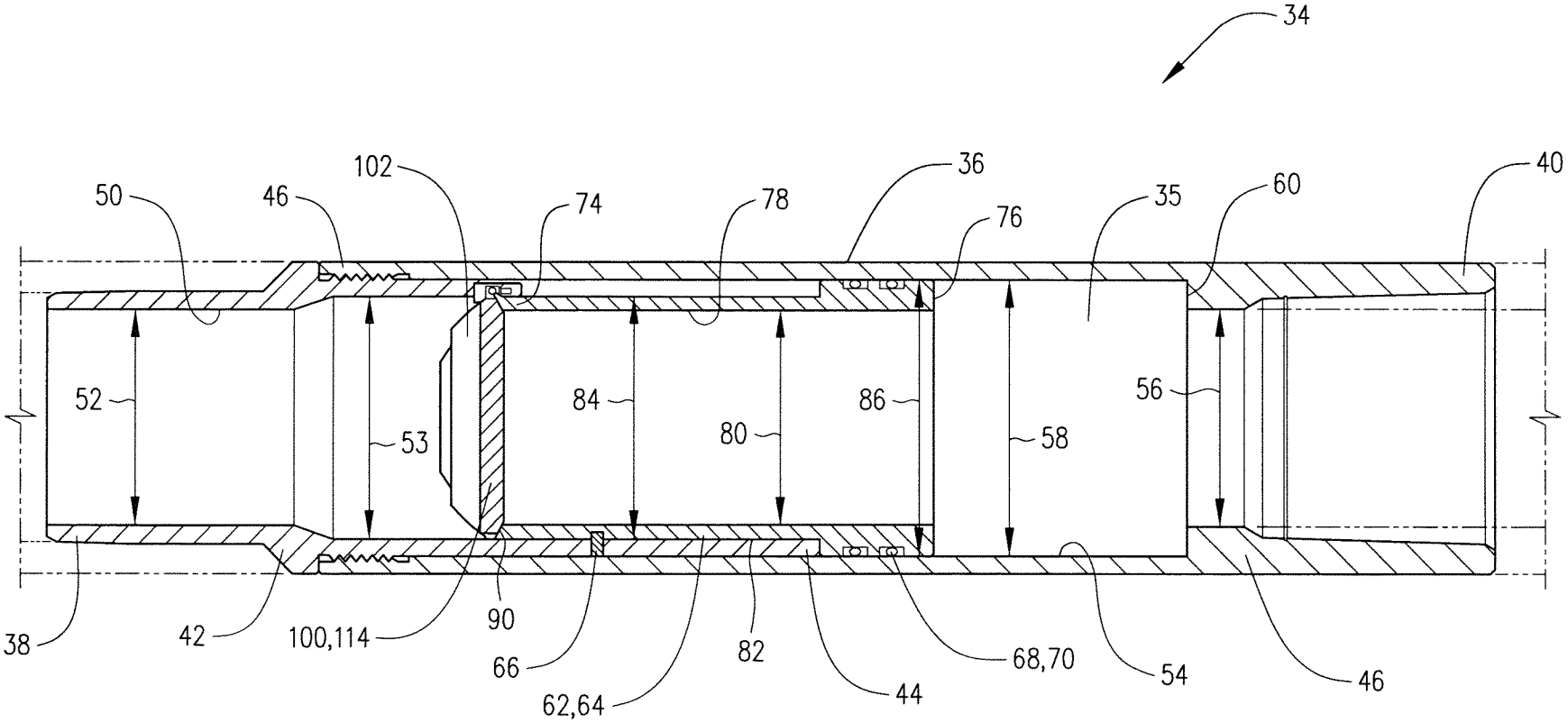
FIG. 2 is a cross section of a buoyancy assist tool of the current disclosure in a closed position.

A retaining sleeve 62 is releasably attached in housing 36. The retaining sleeve 62 is sealingly and slidably received in housing 36. Retaining sleeve 62 is movable from a first position 64 as shown in FIG. 2 to a second position 72 shown in FIGS. 3 through 5. Retaining sleeve 62 is held in first position 64 by a shear pin 66 extending from housing 36 into retaining sleeve 62. In the embodiment shown shear pin 66 is in top sub 42. Retaining sleeve 62 has O-ring or other sealing elements 68 disposed in grooves 70 to sealingly engage housing 36 and more specifically to sealingly engage bottom sub 46 of housing 36.

Retaining sleeve 62 has upper end 74 and lower end 76. Retaining sleeve 62 has inner surface 78 defining an inner diameter 80. Inner diameter 80 is generally the same, or slightly larger than diameters 52 and 56. Diameters 56 and 53 are thus the most restrictive in the flow path 35 through the buoyancy assist tool 34. An outer surface 82 of retaining sleeve 62 has first outer diameter 84 and second outer diameter 86. Grooves 70 are defined in second outer diameter 86. Upper end 74 has a generally concave shaped upper end which is an upwardly facing concave 86. Upper end 74 may have a radius of curvature 88. As further described herein, upper end 74 is shaped and configured so that it will sealingly engage a flapper disk to prevent flow through housing 36 in the first position of the retaining sleeve 62 which is also referred to as the first position of the buoyancy assist tool 34. Upper end 74 will sealingly engage the flapper disk 100. In the embodiment described a seal 90 which may be a rubber seal or other material is at upper end 74 and will sealingly engage the flapper disk 100. Flapper disk 100 and upper end 74 may also be a metal to metal seal.

Figure 3:
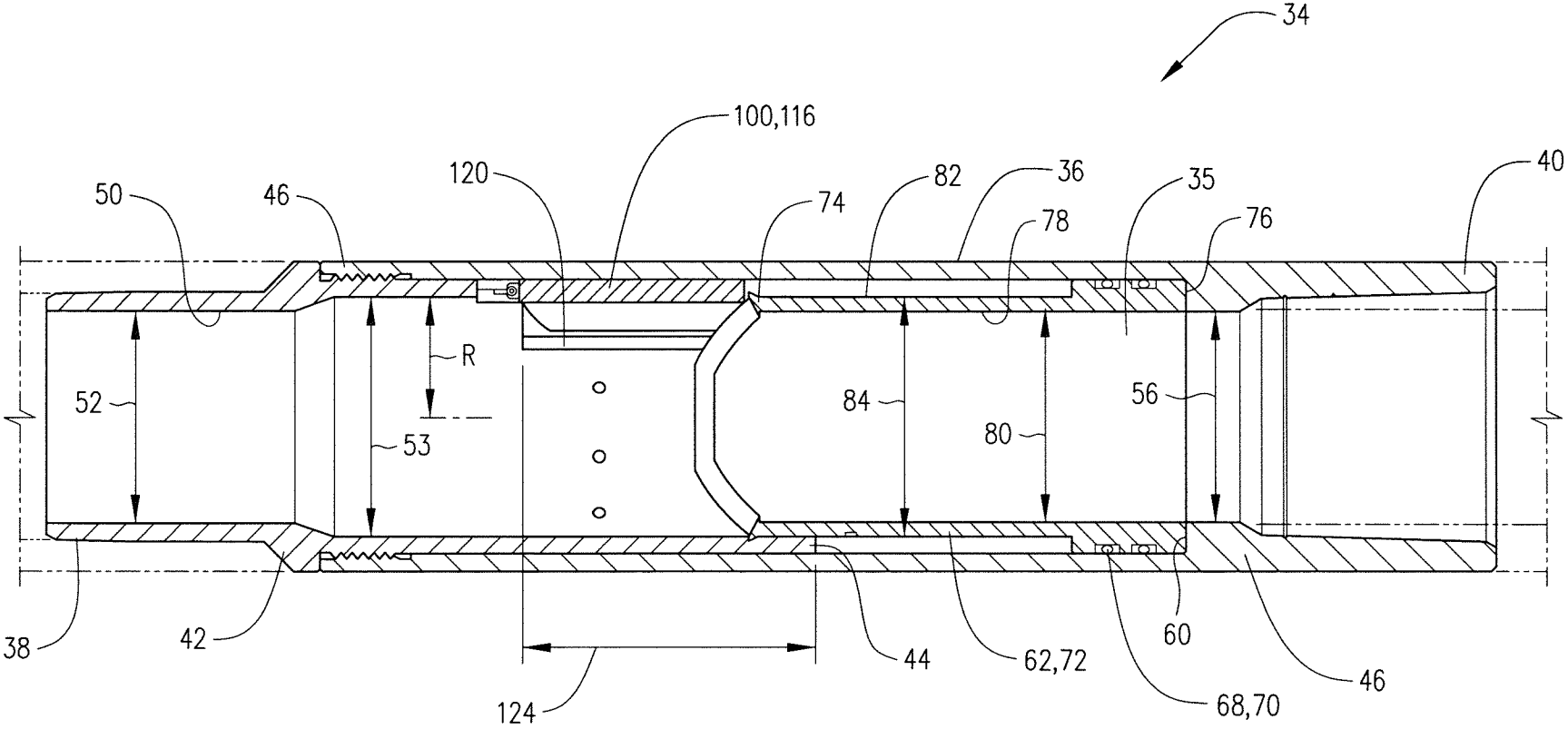
FIG. 3 is a cross section of the buoyancy assist tool of the current disclosure in an open position.
Figure 4:
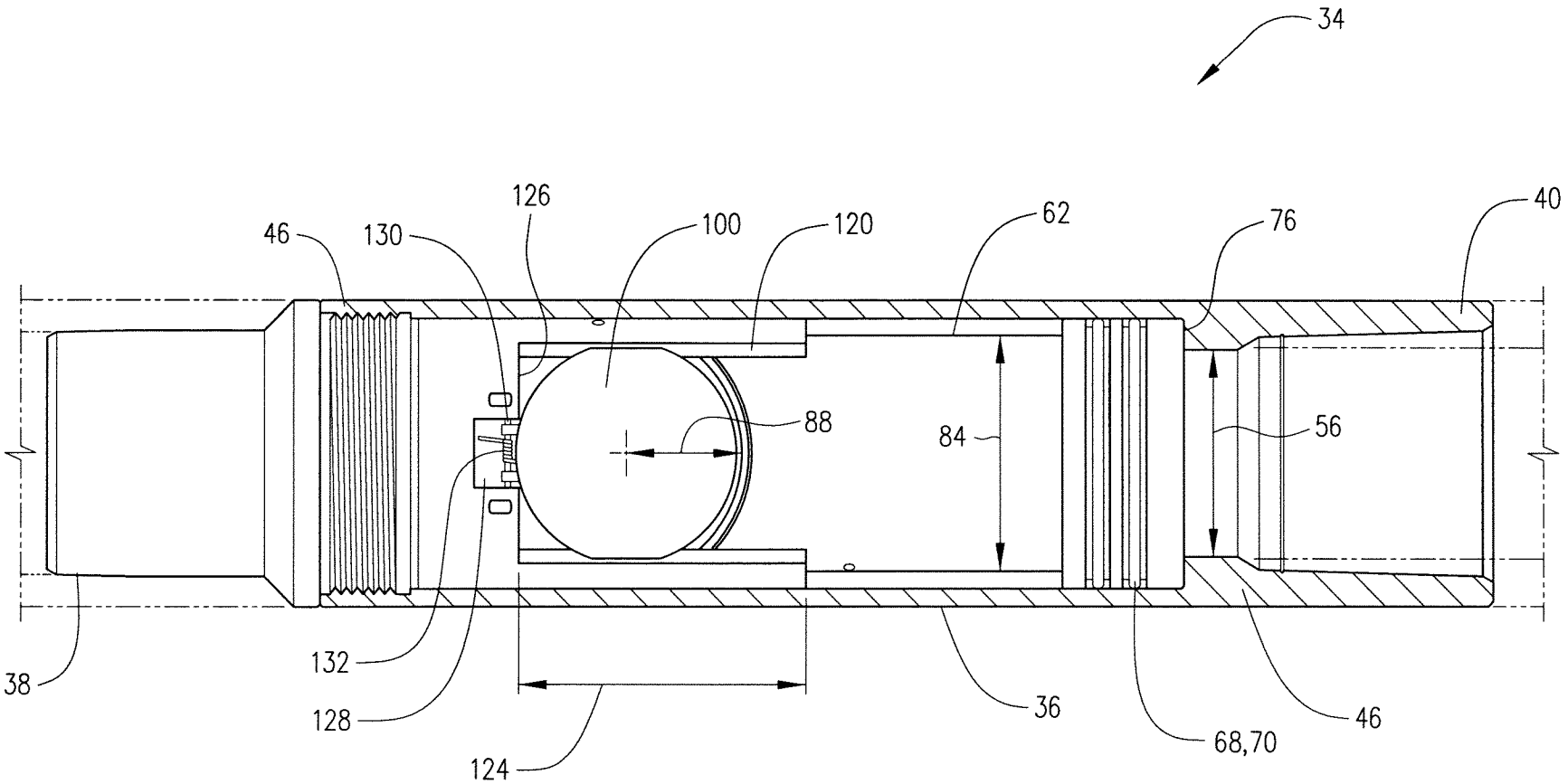
FIG. 4 is a view 90° from the section in FIG. 3 showing the bottom sub in cross-section.
Figure 5:
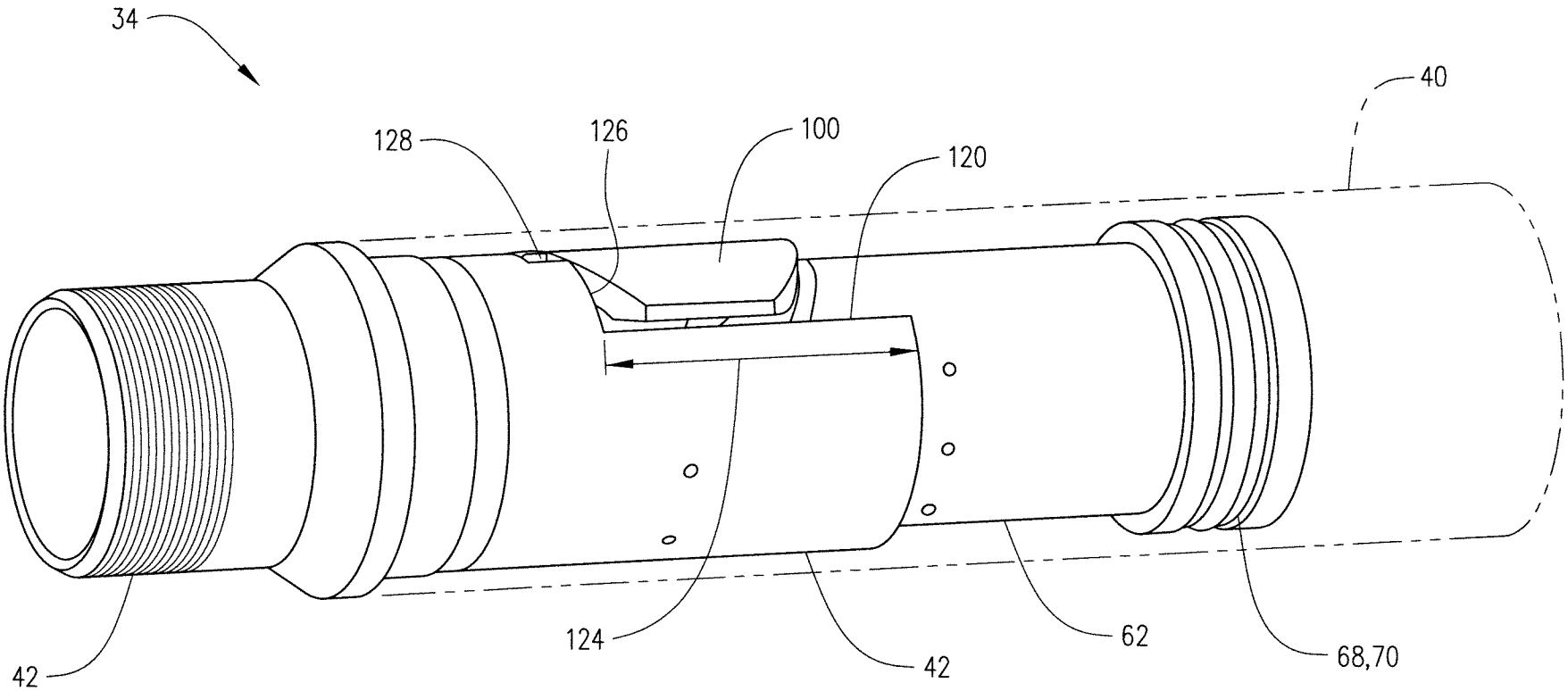
FIG. 5 is a perspective view of the buoyancy assist tool in an open position.
Figure 8:
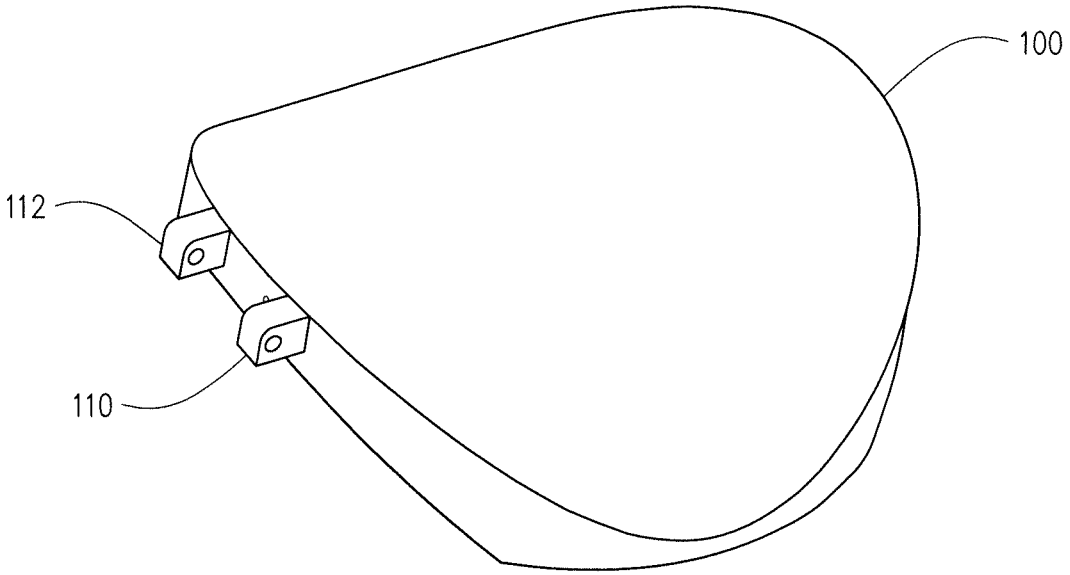
FIG. 8 is a bottom plan view of the flapper disk of the current disclosure.
Figure 7:
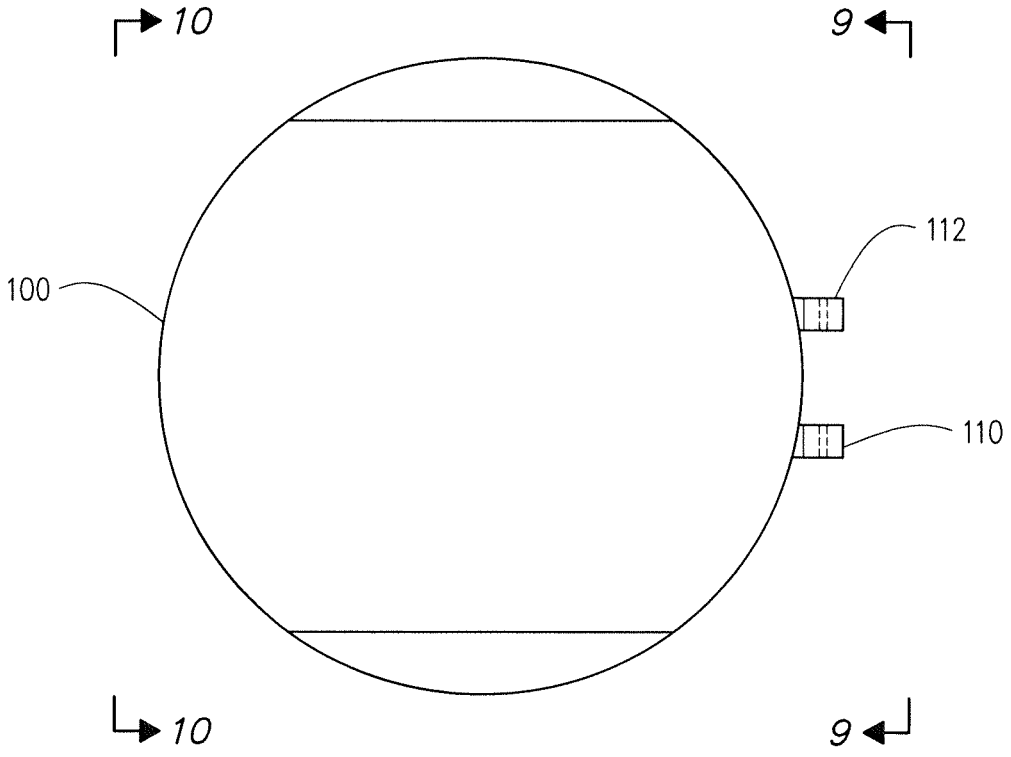
FIG. 7 is a top plan view of the flapper disk of the current disclosure.
Figure 2:
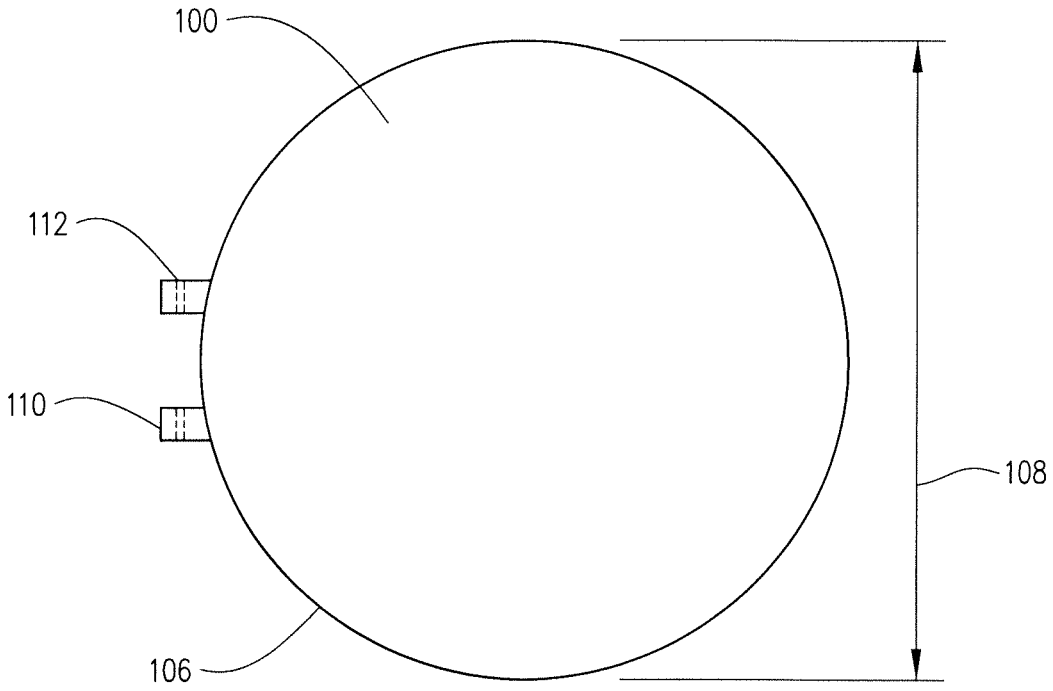
Figure 3:
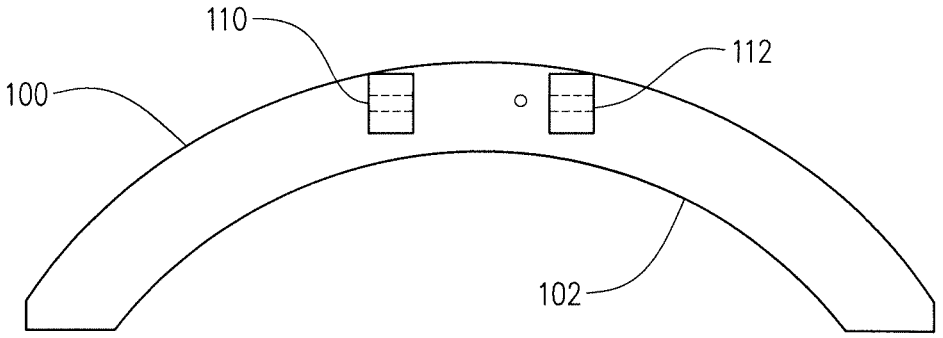
Figure 10:
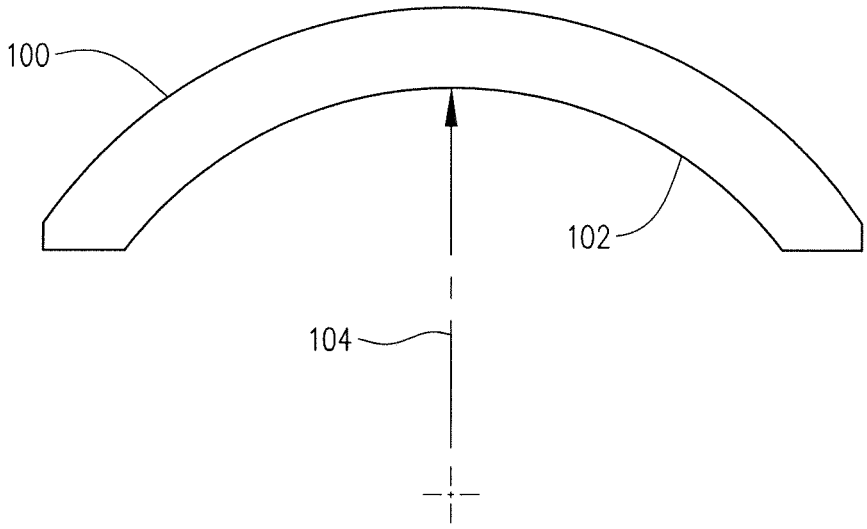
FIG. 10 is a view from line 10-10 of FIG. 7.
Figure 11:
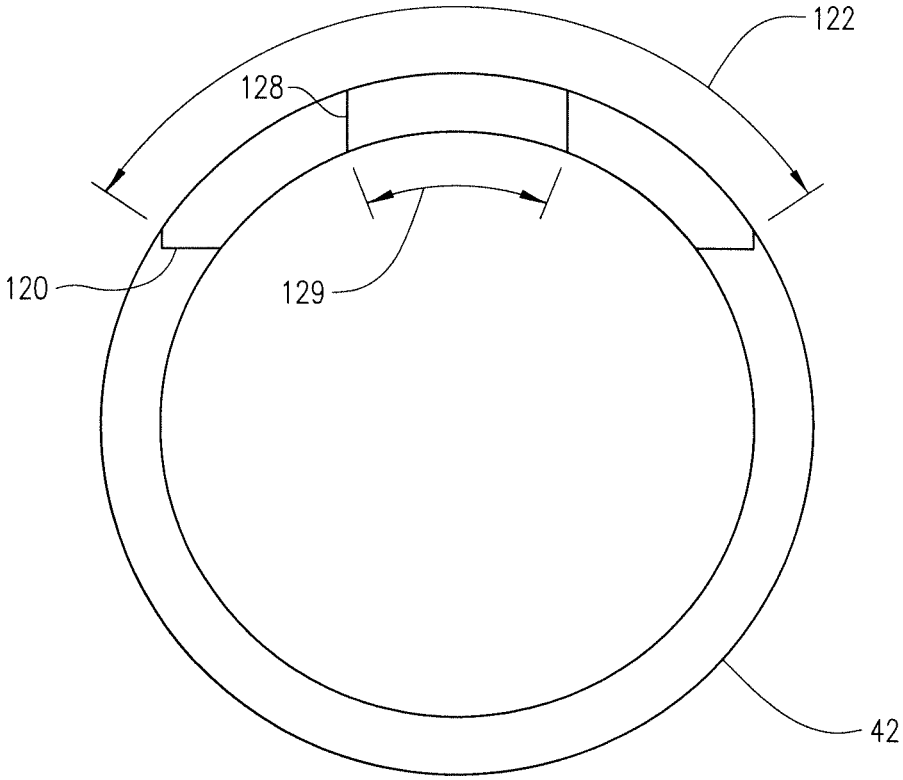
FIG. 11 is a view looking up from the bottom end of the top sub of the current disclosure.

Flapper disk 100 is pivotably connected in housing 36 and is pivotable between a first closed position as shown in FIG. 2 and a second, open position as shown in FIGS. 3 through 5. The open position may also be referred to as the retracted position. Flapper disk 100 has an upward facing concave surface 102 and thus is an upward facing concave flapper disk. The radius of curvature 104 of the concavity of flapper disk 100 is generally the same as the radius R of top sub 42.

A diameter 108 of a circle defined by the outer peripheral edge 106 will be, for example, slightly smaller than the diameter 53 of top sub 42.

Spaced apart lugs 110 extend from peripheral edge 106 and have openings 112 therethrough. Flapper disk 100 is pivotable between the first position 114 as shown in FIG. 2 and the second position 116 as shown in FIGS. 3 through 5.

Top sub 42 has an arc shaped opening 120 with an arc length 122 extending upwardly longitudinally for a distance 124 from the bottom end 44 of top sub 42. Opening 120 has an upper end 126. An arc shaped pivot pin cutout 128 extends upwardly from upper end 126. The arc length 129 of cutout 128 is smaller than arc length 122. A pin 130 extends across cutout 128 into the wall of top sub 42. Pin 130 extends through openings 112. A spring 132 of a type known in the art may be utilized to bias the flapper disk 100 towards the open position. Thus, in the first, or closed position 64 which is the closed position of the buoyancy assist tool 34, the flapper disk 100 and retaining sleeve 62, flapper disk 100 will be biased toward the upper end of retaining sleeve 62 and will sealingly engage to prevent flow through buoyancy assist tool 34.

In operation casing string 18 is lowered into well bore 12 to a desired location. Running a casing such as casing 18 in deviated wells and long horizontal wells often results in significantly increased drag forces and may cause a casing string to become stuck before reaching the desired location in the well bore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example, production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into horizontal portion 16 to the desired location.

Once the casing string 18 has reached the desired position in the well bore, pressure is increased and fluid pumped through the casing string 18. When pressure reaches a pre-determined level in the casing string the flapper disk 100 will push downwardly on retaining sleeve 62 which will cause shear pin 66 to break. Retaining sleeve 62 will slide downwardly, and flapper disk 100 will move to the second position in which it does not provide a restriction to fluid flow or to the passage of tools through the buoyancy assist tool 34.

In the open position flapper disk 100 is received in arc shaped opening 120. Thus the flapper disk 100 in the open, or retracted position is completely out of the flow path through the buoyancy assist tool 34. The inner diameters of buoyancy assist tool 34, namely inner diameters 52 and 56 which are the minimum inner diameters will be such that no restriction will be created to the passage of tools therethrough other than the restriction already provided by the casing string 18 thereabove. Thus, in the open position buoyancy assist tool 34 provides for an open bore or open passageway therethrough with no restrictions to flow and no restrictions to the passage of tools that is more limiting than the casing string 18 thereabove.

A downhole apparatus comprises a fluid barrier connected in a casing string and a buoyancy assist tool connected in the casing string above the fluid barrier. The fluid barrier and buoyancy assist tool define a buoyancy chamber therebetween. The buoyancy assist tool comprises a housing connected in the casing string at upper and lower ends of the housing and a retaining sleeve detachably connected in the housing. The retaining sleeve is movable from a first to a second position in the housing.

A flapper disk is positioned in the housing and covers an upper end of the retaining sleeve to prevent flow therethrough in the first position of the retaining sleeve, and is movable to a retracted position in the second position of the retaining sleeve. The flapper disk in the retracted position is completely out of the flow path through the housing and the retaining sleeve. The housing and retaining sleeve define an open passageway therethrough when the flapper disk is in the retracted position.

The housing comprises a top sub connected in the casing string at its upper end and a bottom sub connected at an upper end to the top sub and at its lower end to the casing string. The flapper disk is pivotably connected to the top sub. In one embodiment the flapper disk is an upward facing concave flapper disk. The concavity of the flapper disk has a radius of curvature generally the same as the radius of the top sub. An upper end of the retaining sleeve may be configured to sealingly engage the flapper disk in the first position of the retaining sleeve.

The top sub has an arc shaped opening extending longitudinally along a portion of the length thereof, and the flapper disk is configured to be received in the arc shaped opening in the retracted position thereof.

A downhole apparatus comprises an outer housing configured at upper and lower ends to connect in a casing string. A retaining sleeve is releasably connected in a first position in the outer housing and movable from the first to a second position in the housing. A concave flapper disk is connected in the housing and covers an opening at an upper end of the retaining sleeve to block flow therethrough in the first position of the retaining sleeve. The flapper disk is movable to a retracted position in which the concave flapper disk does not provide any restriction to flow through the housing in the second position of the retaining sleeve, and thus is completely out of the flow path defined through the buoyancy assist tool. An upper end of the retaining sleeve has a contour configured such that in the first position of the retaining sleeve the flapper disk sealingly engages the upper end of the retaining sleeve.

The flapper disk is pivotably connected in the housing. The housing may comprise a top sub and a bottom sub with the top sub having an arc shaped cutout extending upwardly from a lower end thereof along a portion of the length of the top sub. The arc shaped opening is configured to receive the flapper disk in the retracted position thereof. The flapper disk has a radius of curvature, and may for example have a radius of curvature substantially equal to the radius of the top sub.

A pivot pin is fixed to the housing in one embodiment and a pair of lugs extend from a peripheral edge of the flapper disk. The lugs define openings therethrough and the pivot pin extends through the openings in the lugs. The flapper disk is rotatable about the pivot pin. The retaining sleeve comprises an inner surface defining a generally cylindrical open bore from an upper end to a lower end thereof. The upper end of the retaining sleeve is shaped to sealingly engage the flapper disk in the first position of the retaining sleeve. The upper end of the retaining sleeve in one embodiment has a rubber seal thereon configured to sealingly engage the flapper disk in the first position for the retaining sleeve.

A downhole apparatus may also comprise a buoyancy assist tool having upper and lower ends positioned in a well. A plurality of casing joints are positioned in the well above the buoyancy assist tool and configured to lower the buoyancy assist tool in the well. A plurality of casing joints connect the lower end of the buoyancy assist tool to a flow barrier. The flow barrier and the buoyancy assist tool define a buoyancy chamber therebetween.

The buoyancy assist tool comprises a housing having a top sub and a bottom sub connected to the top sub. A retaining sleeve is releasably connected in a first position to the top sub and is movable to a second position in the housing. The retaining sleeve sealingly engages the bottom sub. A flapper disk is pivotably connected to the top sub and pivotable from a first closed position to a second open position in which the flapper disk provides no restriction to flow through the housing. The retaining sleeve is configured to move from the first to the second position thereof at a predetermined pressure, and the flapper disk configured to move to the open position thereof when the retaining sleeve moves to the second position. The flapper disk comprises an upward facing concave flapper disk. An upper end of the retaining sleeve is configured to sealingly engage the flapper disk in the closed position of the flapper disk. The concavity of the flapper disk has a radius of curvature substantially equal to the radius of the top sub. The concave flapper disk is received in a cutout defined in the top sub in the open position.

A downhole apparatus comprises an outer housing. A retaining sleeve is releasably connected in a first position in the outer housing and is movable from the first to a second position in the housing. A flapper disk is connected in the housing and covers an opening at an upper end of the retaining sleeve to block flow therethrough in the first position of the retaining sleeve, and is movable to a retracted position in which the flapper disk does not provide any restriction to flow through the housing in the second position of the retaining sleeve. The downhole apparatus may be connected in a casing string and a flow barrier connected in the casing string. The outer housing may be connected in the casing string above the flow barrier, and the flow barrier and the flapper disk define a buoyancy chamber therebetween. The upper end of the retaining sleeve has a contour configured such that in the first position of the sleeve the flapper disk sealingly engages the upper end of the retaining sleeve. The flapper disk may be pivotably connected in the housing. The housing can comprise a top sub and a bottom sub. The top sub has a cutout extending upwardly from a lower end thereof along a portion of the length of the top sub. The cutout is configured to receive the flapper disk in the retracted position thereof. The cutout may comprise an arc shaped cutout. The downhole apparatus may comprise a pivot pin fixed to the housing and a pair of lugs extending from a peripheral edge of the flapper disk, the lugs defining openings therethrough, the pivot pin extending through the openings in the lugs and the flapper disk being rotatable about the pivot pin. The retaining sleeve has an inner surface defining a generally cylindrical open bore from an upper end to a lower end thereof. The upper end of the retaining sleeve may have a rubber seal thereon configured to sealingly engage the flapper disk in the first position of the retaining sleeve. The flapper disk may comprise a concave flapper disk wherein the concavity of the flapper disk has a radius of curvature generally the same as a radius of the top sub. The concave flapper disk comprises an upward facing concave flapper disk.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A downhole apparatus comprising:

a casing string;

a fluid barrier connected in the casing string; and a buoyancy assist tool connected in the casing string above the fluid barrier, the fluid barrier and buoyancy assist tool defining a buoyancy chamber filled with a buoyant fluid therebetween, the buoyancy assist tool comprising:

a housing connected in the casing string at upper and lower ends of the housing;

a retaining sleeve detachably connected in the housing and movable longitudinally relative to the housing from a first to a second position in the housing; and a flapper disk positioned in the housing covering an upper end of the retaining sleeve to prevent downward flow therethrough in the first position of the retaining sleeve, the retaining sleeve movable longitudinally relative to the flapper disk, wherein the flapper disk engages the upper end of the retaining sleeve and pushes the retaining sleeve downward in the housing upon the application of a pressure in the housing above the flapper disk.

2. The downhole apparatus of claim 1, the housing comprising a top sub connected in the casing string at its upper end and a bottom sub connected at an upper end to the top sub and at its lower end to the casing string, the flapper disk being pivotably connected to the top sub.

3. The downhole apparatus of claim 1 the flapper disk pivotably connected to the housing and movable to a retracted position in the second position of the retaining sleeve, the flapper disk in the retracted position being completely out of the flow path through the housing and the retaining sleeve.

4. The downhole apparatus of claim 1, an upper end of the retaining sleeve configured to sealingly engage the flapper disk in the first position of the retaining sleeve.

5. The downhole apparatus of claim 1, the flapper disk comprising an upward facing concave flapper disk, the concavity of the flapper disk having a radius of curvature generally the same as the radius of the top sub.

6. The downhole apparatus of claim 2, the top sub having an arc shaped opening extending longitudinally along a portion of the length thereof, the flapper disk configured to be received in the arc shaped opening in the retracted position thereof.

7. A downhole apparatus comprising:

an outer housing configured at upper and lower ends to connect in a casing string;

a retaining sleeve releasably connected in a first position in the outer housing and movable relative to the housing from the first to a second position in the housing; and a flapper disk pivotably connected to the outer housing and covering an opening at an upper end of the retaining sleeve to block downward flow therethrough in the first position of the retaining sleeve, the flapper disk movable to a retracted position in which the flapper disk does not provide any restriction to flow through the outer housing in the second position of the retaining sleeve, the retaining sleeve being releasable from the outer housing and movable therein to the second position in the outer housing upon the application of a downward force applied thereto by the flapper disk.

8. The downhole apparatus of claim 7, an upper end of the retaining sleeve having a contour configured such that in the first position of the sleeve the flapper disk sealingly engages the upper end of the retaining sleeve.

9. The downhole apparatus of claim 7, the housing comprising a top sub and a bottom sub, the top sub having an arc shaped cutout extending upwardly from a lower end thereof along a portion of the length of the top sub, the arc shaped opening configured to receive the flapper disk in the retracted position thereof.

10. The downhole apparatus of claim 7, the retaining sleeve movable longitudinally relative to the flapper disk.

11. The downhole apparatus of claim 7, further comprising:

a pivot pin fixed to the housing; and a pair of lugs extending from a peripheral edge of the flapper disk, the lugs defining openings therethrough, the pivot pin extending through the openings in the lugs and the flapper disk being rotatable about the pivot pin.

12. The downhole apparatus of claim 11, the retaining sleeve comprising an inner surface defining a generally cylindrical open bore from an upper end to a lower end thereof, the upper end shaped to sealingly engage the flapper disk in the first position of the retaining sleeve.

13. The downhole apparatus of claim 12, the upper end of the retaining sleeve having a rubber seal thereon configured to sealingly engage the flapper disk in the first position of the retaining sleeve.

14. A downhole apparatus comprising:

a buoyancy assist tool having upper and lower ends positioned in a well;

a flow barrier;

a plurality of casing joints positioned in the well above the buoyancy assist tool and configured to lower the buoyancy assist tool in the well; and a plurality of casing joints connecting the lower end of the buoyancy assist tool to the flow barrier, the flow barrier and the buoyancy assist tool defining a buoyancy chamber filled with a buoyant fluid therebetween, the buoyancy assist tool comprising:

a housing comprising a top sub and a bottom sub connected to the top sub;

a retaining sleeve detachably connected in a first position to the top sub and movable longitudinally in the housing to a second position in the housing, the retaining sleeve sealingly engaged with the bottom sub; and a flapper disk pivotably connected to the top sub and pivotable from a first closed position in which downward flow through the retaining sleeve is prevented to a second open position in which the flapper disk provides no restriction to flow through the housing as a result of the retaining sleeve being released from the top sub, wherein the flapper disk pushes downwardly on the retaining sleeve upon the application of a pressure in the housing to detach the retaining sleeve from the housing.

15. The downhole apparatus of claim 14, wherein the retaining sleeve moves from the first to the second position thereof when it is released from the housing, and wherein the flapper disk moves to the open position thereof when the retaining sleeve moves to the second position.

16. The downhole apparatus of claim 14, the retaining sleeve being movable longitudinally relative to the flapper disk.

17. The downhole apparatus of claim 14, an upper end of the retaining sleeve configured to sealingly engage the flapper disk in the closed position of the flapper disk.

18. The downhole tool of claim 14, the flapper disk comprising an upward facing concave flapper disk having a radius of curvature substantially equal to the radius of the top sub.

19. The downhole tool of claim 18, the concave flapper disk being received in a cutout defined in the top sub in the open position.

* * * * *